US008171996B2

(12) United States Patent
Jennings

(10) Patent No.: US 8,171,996 B2
(45) Date of Patent: May 8, 2012

(54) WELLHEAD SYSTEM HAVING A TUBULAR HANGER SECURABLE TO WELLHEAD AND METHOD OF OPERATION

(75) Inventor: Charles E. Jennings, Tomball, TX (US)

(73) Assignee: Vetco Gray Inc., Houston, TX (US)

( * ) Notice: Subject to any disclaimer, the term of this patent is extended or adjusted under 35 U.S.C. 154(b) by 383 days.

(21) Appl. No.: 12/432,252

(22) Filed: Apr. 29, 2009

(65) Prior Publication Data

US 2010/0276156 A1 Nov. 4, 2010

(51) Int. Cl.
*E21B 43/10* (2006.01)

(52) U.S. Cl. ..... 166/344; 166/379; 166/208

(58) Field of Classification Search ..... 166/344, 166/368, 379, 208
See application file for complete search history.

(56) References Cited

U.S. PATENT DOCUMENTS

| | | | | |
|---|---|---|---|---|
| 5,044,441 | A * | 9/1991 | Rubbo et al. | 166/382 |
| 5,327,965 | A * | 7/1994 | Stephen et al. | 166/208 |
| 5,503,230 | A * | 4/1996 | Osborne et al. | 166/344 |
| 7,607,485 | B2 | 10/2009 | Fenton et al. | |
| 7,909,103 | B2 | 3/2011 | Fenton | |
| 7,931,079 | B2 | 4/2011 | Nicholson | |
| 2008/0308278 | A1 * | 12/2008 | Adamek et al. | 166/348 |

* cited by examiner

*Primary Examiner* — William P Neuder
(74) *Attorney, Agent, or Firm* — Bracewell & Giuliani LLP

(57) ABSTRACT

A technique is provided for installing a tubular hanger and tubular hanger seal in a wellhead. The technique comprises installing the tubular hanger with a setting tool. The tubular hanger may comprise a locking ring that is driven outward into engagement with a profile in the wellhead. The setting tool is adapted to rotate a moveable member of the tubular hanger relative to the tubular hanger body so as to drive the moveable member to expand the locking ring outward to engage a profile in the wellhead. The moveable member may be wedged between the locking ring and the tubular hanger body. The setting tool may be adapted to enable the moveable member and the tubular hanger body to be rotated independently. The annulus between the tubular hanger and the wellhead may be sealed by a seal that has a plurality of sealing elements that are coupled together by a series of catches.

13 Claims, 6 Drawing Sheets

WELLHEAD SYSTEM HAVING A TUBULAR HANGER SECURABLE TO WELLHEAD AND METHOD OF OPERATION

BACKGROUND

The invention relates generally to wellhead systems for use with oil and gas wells. In particular, the invention relates to a wellhead system having a tubular hanger that is securable to a wellhead.

A typical oil and/or gas well utilizes strings of casing that are supported from a casing hanger that is, in turn, supported by a wellhead assembly. The strings of casing serve many purposes. For example, casing strings may be used to define the wellbore at various stages of drilling to keep formation fluids out of the wellbore and drilling mud in the wellbore.

Thermal changes in the casing string may produce forces that drive the casing string to lengthen or shorten. For example, if the well is shut-in, warm production fluid will not flow through the well. This allows the casing string to be cooled down by its surroundings. For example, seawater may cool down the wellhead and casing in a subsea well. This cooling may produce thermal contraction of the casing string. Conversely, when a flow of production fluid is initiated, the warm temperature of the production fluid may produce thermal expansion of the casing string.

Oil and/or gas, typically, are produced from the wellbore via production tubing, rather than from a casing string. The production tubing is supported from a tubing hanger. The location of the tubing hanger in a wellhead is important to enable an external device to be coupled to the tubing hanger. Typically, a tubing hanger is supported by a casing hanger disposed within a wellhead. However, as noted above, thermal forces may cause the casing string to expand or contract, thus causing the position of the tubing hanger to vary.

As a result, there is a need for a technique that addresses some or all of the problems described above. The techniques described below may address one or more problems described above.

BRIEF DESCRIPTION

A technique is provided for installing a tubular hanger and tubular hanger seal in a wellhead. The technique comprises installing the tubular hanger with a setting tool. In an exemplary embodiment, the tubular hanger comprises a locking ring that is driven outward into engagement with a profile in the wellhead. The setting tool is adapted to rotate a moveable member of the tubular hanger relative to the tubular hanger body so as to drive the moveable member to expand the locking ring outward to engage a profile in the wellhead. In the exemplary embodiment, the tubular hanger also comprises a feeler ring to engage a second profile in the wellhead. The engagement of the feeler ring with the second profile in the wellhead aligns the locking ring with the profile in the wellhead so that the locking ring engages the profile when it is driven outward. The setting tool is then rotated in an opposite direction to disengage the setting tool from the tubular hanger.

The setting tool is adapted to enable the moveable member and the tubular hanger body to be rotated independently. This enables the setting tool to be rotated in a first direction to secure the tubular hanger to the wellhead and rotated in a second direction to release the setting tool from the tubular hanger.

The annulus between the tubular hanger and the wellhead may be sealed by a seal that has a plurality of sealing elements that are coupled together by a series of catches. The seal may be rotated to drive the sealing elements outward. If it is desired to remove the seal, the seal is rotated in the opposite direction and then lifted. During lifting, the catches of an upper sealing element engage the catches of a lower sealing element, pulling the lower sealing element upward.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
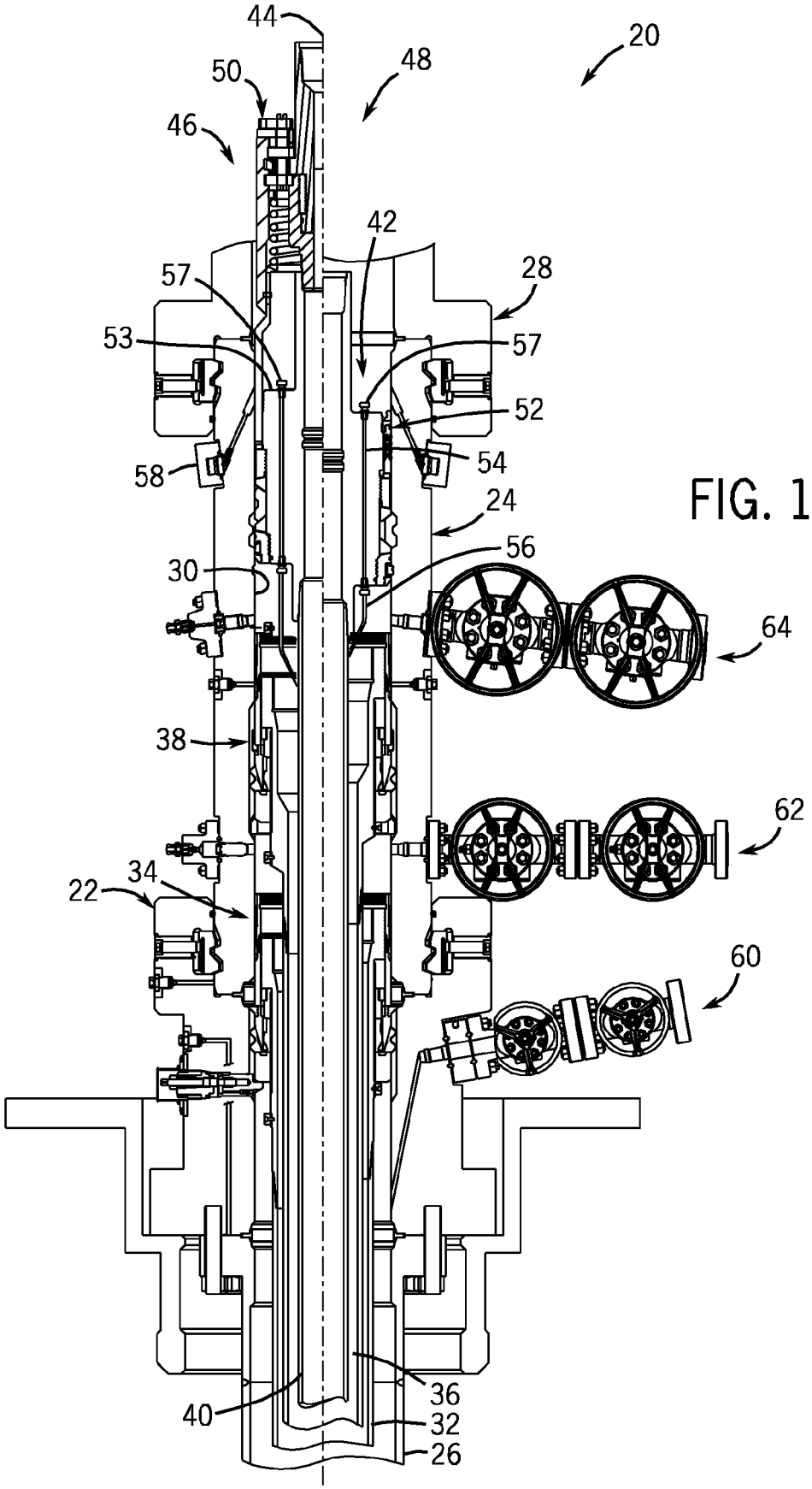
FIG. 1 is a cross-sectional view of a wellhead assembly and a tubing hanger/seal setting tool, in accordance with an exemplary embodiment of the present technique.

Referring now to FIG. 1, the present invention will be described as it might be applied in conjunction with an exemplary wellhead assembly 20. The wellhead assembly 20 enables production fluids to be withdrawn from a wellbore. In the illustrated embodiment, the wellhead assembly 20 comprises a low pressure wellhead 22 and a high pressure wellhead 24. The high pressure wellhead 24 is exposed to high pressure wellbore fluids. The low pressure wellhead 22 is secured to a conductor 26 that extends into the ground. In addition, a connector 28 is secured to the high pressure wellhead 24 to enable access to a bore 30 that extends from the connector 28 downward through the wellhead assembly 20 to the wellbore.

In the illustrated embodiment, an outer casing string 32 is supported from the high pressure wellhead 24 by a first casing hanger 34. The outer casing string 32 extends from the first casing hanger 34 into the wellbore. An inner casing string 36 is supported from the high pressure wellhead 24 by a second casing hanger 38. The inner casing string 36 extends from the second casing hanger 38, through the outer casing string 32, and into the wellbore beyond the bottom of the outer casing string 32. As will be discussed in more detail below, this embodiment of the second casing hanger 38 is an adjustable casing hanger that enables the height of the inner casing string 36 to be varied by applying a tensile force to the inner casing string 36.

Production tubing 40 is supported from the high pressure wellhead 24 by a tubing hanger 42. The production tubing 40 extends from the tubing hanger 42 through the inner casing string 36 to a desired depth. Because the second casing hanger 38 is adjustable, there may be some vertical movement of the second casing hanger 38. As will be discussed in more detail below, the illustrated embodiment of the tubing hanger 42 is not supported by the second casing hanger 38. Instead, the tubing hanger 42 is located above the second casing hanger 38 and is rigidly locked to, and supported by, the high pressure wellhead 24, so that the production tubing 40 is unaffected by any changes in the position of the second casing hanger 38 or the inner casing string 36.

In the illustrated embodiment, an axis 44 has been provided to divide the wellhead assembly 20 in half to illustrate a pre-installed configuration 46 of the tubing hanger 42 and an installed configuration 48 of the tubing hanger 42. The left portion 46 reflects the wellhead assembly 20 prior to securing the tubing hanger 42. The right portion reflects the wellhead assembly 20 after the tubing hanger 42 is secured in the wellhead assembly 20 with a setting tool 50. The installed configuration 48 of the wellhead assembly 20 also illustrates a tubing hanger seal 52 that is provided to form a seal between the tubing hanger body 53 and the high pressure wellhead 24.

The wellhead assembly 20 has several additional components. The tubing hanger 42 has ports 54 that extend through the tubing hanger body 53 to enable fluid from control lines 56 to pass through the tubing hanger 42. The control lines 56 are used to control a downhole safety valve (not shown). The control lines 56 are connected to connectors 57 on the tubing hanger 42. The control lines 56 may be accessed by control line terminations 58 that extend through the high pressure wellhead 24. In addition, a variety of valve assemblies are provided to enable access to annulus portions of the bore 30. A first valve assembly 60 is provided to drain the annulus above the outer casing string 32 and the bore 30 of the wellhead assembly 20. A second valve assembly 62 is provided to drain the annulus above the first casing hanger assembly 34 and below the adjustable casing hanger 38. A third valve assembly 64 is provided to drain the annulus above the adjustable casing hanger 38 below the tubing hanger 42.

Referring generally to FIGS. 2-5, as noted above, the tubing hanger 42 of the wellhead assembly 20 is secured to the high pressure wellhead 24. As will be discussed in more detail below, the setting tool 50 is used to install the tubing hanger 42 and tubing hanger seal 52 in the wellhead assembly 20. In the illustrated embodiment, the tubing hanger 42 comprises a nose ring 66 that supports a feeler ring 68. In the exemplary embodiment shown, the feeling ring 68 is a split ring that is biased to expand outward, in this embodiment. In addition, the high pressure wellhead 24 has a second profile portion 70 that is adapted to receive the feeler ring 68 as the tubing hanger 42 is lowered into the high pressure wellhead 24. The engagement between the feeler ring 68 and the second profile portion 70 of the wellhead 24 blocks further downward movement of the tubing hanger 42.

The primary means of securing the tubing hanger 42 to the high pressure wellhead 24 is a load-bearing ring 72 that is expanded outward to engage a first profile portion 74 of the high pressure wellhead 24. The load-bearing ring 72 is carried into the wellhead 24 on the tubing hanger 42. In the illustrated embodiment, the load-bearing ring 72 is a split ring. However, the load bearing ring 72 is biased inward in this embodiment. The tubing hanger 42 has a first angled ring 76 with an upward-facing angled surface 78 and a second angled ring 80 with a downward-facing angled surface 82 in this view. The load-bearing ring 72 is disposed between the first angled ring 76 and the second angled ring 80. The load-bearing ring 72 has a corresponding downward-facing angled surface 84 and an upward-facing angled surface 86.

In the illustrated embodiment, a threaded ring 88 is disposed on the tubing hanger 42 and rotated in a right-handed direction relative to the tubing hanger 42 to expand the load-bearing ring 72 outward and secure the tubing hanger 42 to the wellhead 24. The right-handed rotation of the threaded ring 88 causes the threaded ring to travel axially down a threaded portion 90 of the tubing hanger 42. The downward travel of the threaded ring 88 drives the second angled ring 80 against the load-bearing ring 72, which is, in turn, driven against the first angled ring 76. The angled surfaces of the load-bearing ring 72, the first angled ring 76, and the second angled ring 80 cooperate to produce a mechanical advantage that drives the load-bearing ring 72 outward to engage the first profile portion 74 of the wellhead 24 as the second angled ring 80 is driven downward by the threaded ring 88. The engagement between the load-bearing ring 72 and the second profile 74 of the wellhead secures the tubing hanger 42 to the wellhead 24. In addition, as the second angled ring 80 is driven downward by the threaded ring 88, the angled surfaces of the load-bearing ring 72, the first angled ring 76, and the second angled ring 80 cooperate to produce a mechanical advantage that drives the first angled ring 76 and the second angled ring 80 inward against the tubing hanger body 53, wedging the first angled ring 76 and the second angled ring 80 between the tubing hanger body 53 and the load-bearing ring 72. This locks the load-bearing ring 72 in the outward position. In addition, driving the first angled ring 76 and the second angled ring 80 against the tubing hanger body 52 produces friction that prevents movement of the first angled ring 76 and the second angled ring 80 relative to the tubing hanger body 53, thereby locking the load-bearing ring 72 rigidly to the tubing hanger body 53. This also locks the tubing hanger 42 rigidly to the wellhead 24, preventing axial movement of the tubing hanger 42 relative to the wellhead 24. In this embodiment, the threaded ring 88 is disposed on the tubing hanger 42 and rotated in a right-handed direction to expand the load-bearing ring 72 outward. However, the tubing hanger 42 and threaded ring 88 may be configured to expand the load-bearing ring 72 outward by rotating the threaded ring 88 in a left-handed direction relative to the tubing hanger 42.

Figure 2:
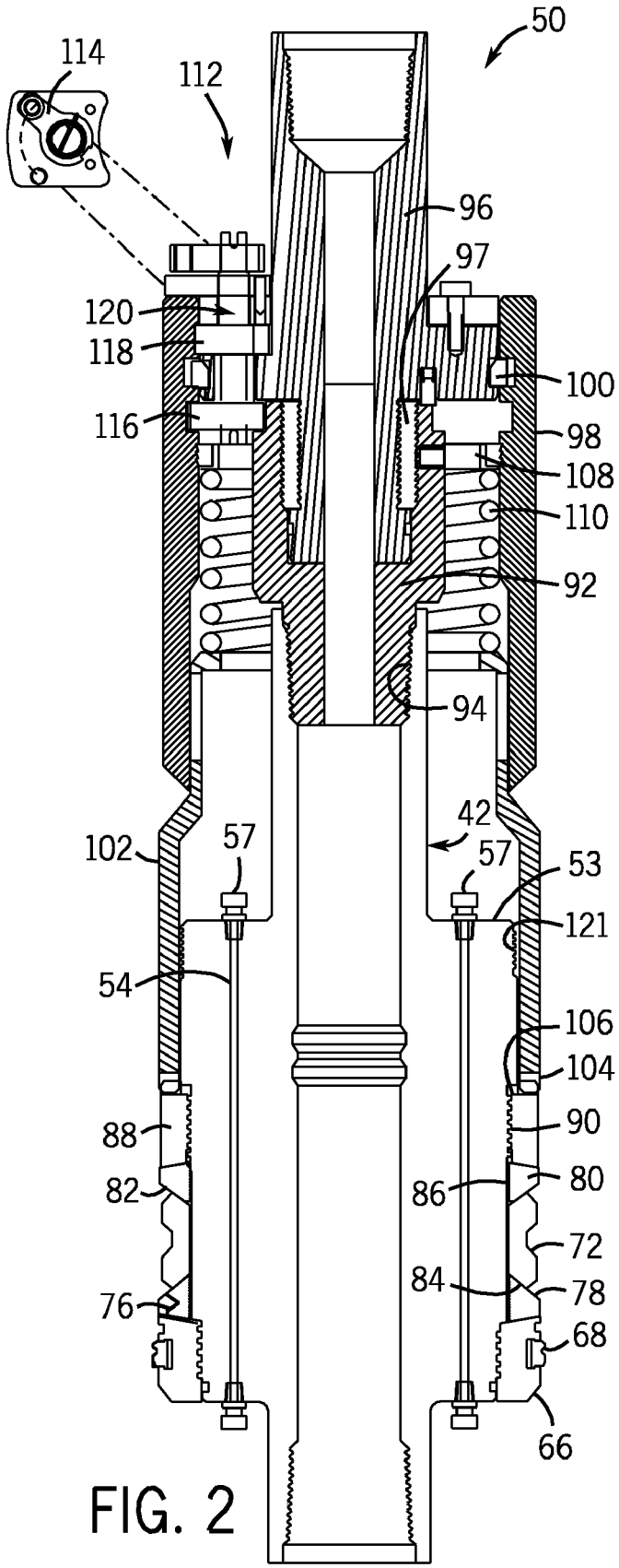
FIG. 2 is a cross-sectional view of the tubing hanger and tubing hanger/seal setting tool of FIG. 1, in accordance with an exemplary embodiment of the present technique.

Referring generally to FIG. 2, the setting tool 50 has a lower stem section 92 that may be threaded into a threaded portion 94 of the tubing hanger 42 and an upper stem section 96 that may be threaded into a pipe string (not shown) for rotation therewith. In this embodiment, the upper stem section 96 is coupled to the lower stem section 92 by a split coupling 97. In addition, the upper stem section 96 is secured to an outer sleeve 98 by a C-ring 100. The setting tool 50 also comprises a telescopic sleeve 102 that is adapted to telescope axially within the outer sleeve 98. The telescopic sleeve 102 is adapted to move axially relative to the outer sleeve 98, but to rotate with the outer sleeve 98. The illustrated embodiment of the telescopic sleeve 102 has a plurality of tabs 104 that may be inserted into corresponding slots 106 on the threaded ring 88 of the tubing hanger 42. A spring plate 108 and a spring 110 cooperate to produce a spring force that urges the telescope sleeve 102 outward from the outer sleeve 98 toward the tubing hanger 42. This spring force urges the tabs 104 into the slots 106 so that rotation of the outer sleeve 98 will produce a corresponding rotation of the threaded ring 88.

The illustrated embodiment of the setting tool 50 comprises a selector assembly 112 that enables the upper stem section 96 to be selectively coupled to the lower stem section 92 and the outer sleeve 98. In this embodiment, a selector switch 114 enables a user to select between two states: a first state and a second state. In the first state, right-handed rotation of the upper stem section 96 is coupled to the lower stem section 92, but not left-handed rotation of the upper stem section 96. Conversely, left-handed rotation of the upper stem section 96 is coupled to the outer sleeve 98, but not right-handed rotation of the upper stem section 96. The first state is selected to secure the setting tool 50 to the tubing hanger 42. This state enables the lower stem section 92 to be threaded to the tubing hanger 42 by rotating the upper stem section 96 in a right-handed direction and using the outer sleeve 98 to hold the tubing hanger 42 so that it does not rotate. In the second state, left-handed rotation of the upper stem section 96 is coupled to the lower stem section 92, but not right-handed rotation of the upper stem section 96. Conversely, right-handed rotation of the upper stem section 96 is coupled to the outer sleeve 98, but not left-handed rotation of the upper stem section 96.

The selector assembly 112 comprises a first engagement member 116 and a second engagement member 118 that are disposed on a rotatable shaft 120 and positioned by the selector switch 114 between two positions. The first position corresponds to the first state and the second position corresponds to the second state. The first engagement member 116 is adapted to interact with the lower stem section 92 and the second engagement member is adapted to interact with the outer sleeve 98. As will be discussed in more detail below, when the selector switch is positioned to the first position, the first engagement member 116 engages the lower stem section 92 when the upper stem section 96 is rotated in a right-handed direction, but the first engagement member 116 ratchets when the upper stem section 96 is rotated in a left-handed direction. On the other hand, when the selector switch is positioned to the first position, the second engagement member 118 engages the outer sleeve 98 when the upper stem section 96 is rotated in a left-handed direction, but ratchets when the upper stem section 96 is rotated in the right-handed direction. The opposite interactions occur when the selector switch 114 is positioned in the second position.

To secure the setting tool 50 to the tubing hanger 42, the selector switch 114 is positioned in the first position, the position corresponding to the first state. The tabs 104 of the telescopic sleeve 102 of the setting tool 50 are inserted into the slots 106 of the threaded ring 88 of the tubing hanger 42. The upper stem section 96 is rotated in a right-handed direction causing the first engagement member 116 to drive lower stem section to thread into the threaded portion 94 of the tubing hanger 42. The second engagement member 118 ratchets along outer sleeve 98 as the upper stem section 96 is rotated.

Figure 3:
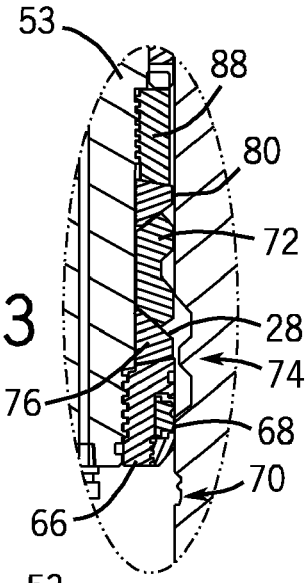
FIGS. 3-5 are cross-sectional views illustrating the installation and securing of the tubing hanger to the wellhead, in accordance with an exemplary embodiment of the present technique.

Referring generally to FIGS. 2 and 3, to install the tubing hanger 42 in the wellhead 24, the selector switch 114 is positioned in the second position, the position corresponding to the second state, and the setting tool 50 and tubing hanger 42 are lowered by the pipe string (not shown). The setting tool 42 and tubing hanger 42 eventually reach the high pressure wellhead 24.

Figure 4:
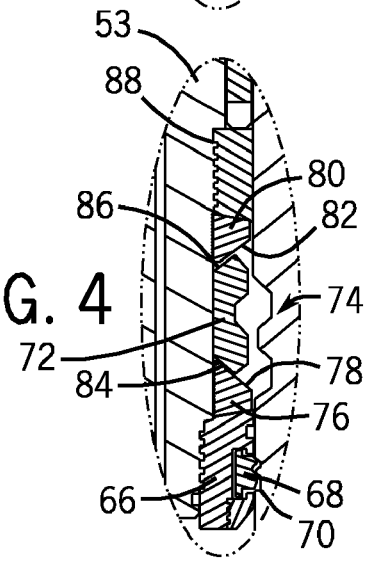

Referring generally to FIGS. 2 and 4, the tubing hanger 42 is lowered until the feeler ring 68 engages the second profile portion 70 of the wellhead 24. The feeler ring 68 aligns the load-bearing ring 72 with the second profile 74 in the high pressure wellhead 24. Thus, when the load-bearing ring 72 is expanded outward, it will engage the second profile 74 in the wellhead 24.

Figure 5:
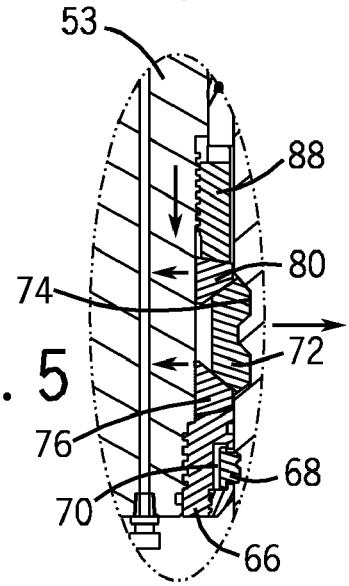

Referring generally to FIGS. 2 and 5, the pipe string is rotated in the right-handed direction to drive the upper stem section 96 of the setting tool 50 into rotation in the right-handed direction. The right-handed rotation of the upper stem section 96 is transmitted to the outer sleeve 98 via the second engagement member 118. The first engagement member 116 ratchets along the lower stem section 92 as the upper stem section 96 is rotated. The right-handed rotation of the outer sleeve 98 is transmitted to threaded ring 88, which travels axially down the tubing hanger body 53 as it is rotated. As discussed above, the angled surfaces of the load-bearing ring 72, the first angled ring 76, and the second angled ring 80 cooperate to produce a mechanical advantage that drives the load-bearing ring 72 outward to engage the first profile portion 74 of the wellhead 24 as the second angled ring 80 is driven downward by the threaded ring 88. In addition, the angled surfaces of the load-bearing ring 72, the first angled ring 76, and the second angled ring 80 cooperate to produce a mechanical advantage that drives the first angled ring 76 and the second angled ring 80 inward against the tubing hanger body 53, wedging the first angled ring 76 and the second angled ring 80 between the tubing hanger body 53 and the load-bearing ring 72. The engagement between the load-bearing ring 72 and the first profile portion 74 of the wellhead 24 secures the tubing hanger 42 to the wellhead 24. In addition, the wedging action of the first angled ring 76 and second angled ring 80 rigidly locks the load-bearing ring 72 to the tubing hanger body 53.

Referring again to FIG. 2, to detach the setting tool 50 from the tubing hanger 42, the pipe string is rotated in the left-handed direction to drive the upper stem section 96 of the setting tool 50 into rotation in the left-handed direction. The left-handed rotation of the upper stem section 96 is transmitted to the lower stem section 92 via the first engagement member 116, but the second engagement member 118 ratchets along the outer sleeve 98. The left-handed rotation of the lower stem section 92 un-threads the lower stem section 92 from the threaded portion 90 of the tubing hanger 42. This detaches the setting tool 50 from the tubing hanger 42, which may then be removed from the wellhead assembly 20.

The setting tool 50 is used to install and remove the seal 52, as well. As will be discussed in more detail below, the setting tool 50 may be used to stab into the seal 52 so that the setting tool 50 may be used to thread the seal 52 onto a threaded portion 121 of the tubing hanger 42. The process of threading the seal 52 onto the tubing hanger 42 secures the seal 52 to the tubing hanger 42 and expands the sealing elements of the seal 52 outward to engage the tubing hanger 42 on one side and the wellhead 24 on the other. Similarly, the setting tool 50 may be stabbed into the seal 52 to unthread and remove the seal 52 from the tubing hanger 42.

To remove the tubing hanger 42 from the wellhead 24, the selector switch 114 is selected to the first position. The setting tool 50 is re-deployed into the wellhead assembly 20 so that the tabs 104 of the telescopic sleeve 102 engage the slots 106 of the tubing hanger 42. The upper stem section 96 is rotated in a left-handed direction. The left-handed rotation of the upper stem section 96 is transmitted to the outer sleeve 98 via the second engagement member 118. The outer sleeve 98, in turn, drives the telescopic sleeve 102, which, in turn, drives the threaded ring 88. The left-handed rotation of the threaded ring 88 causes the threaded ring 88 to move axially upward, in this view, relative to the threaded portion 90 of the tubing hanger 42. This axial movement of the threaded ring 88 enables the load-bearing ring 72 to retract from the first profile portion 74 of the wellhead 24. The setting tool 50 may then be raised to remove the tubing hanger 42 from the wellhead 24. The feeler ring 68 will be retracted into the nose ring 66 as the tubing hanger 42 is raised and eventually removed from the wellhead assembly 20.

Figure 6:
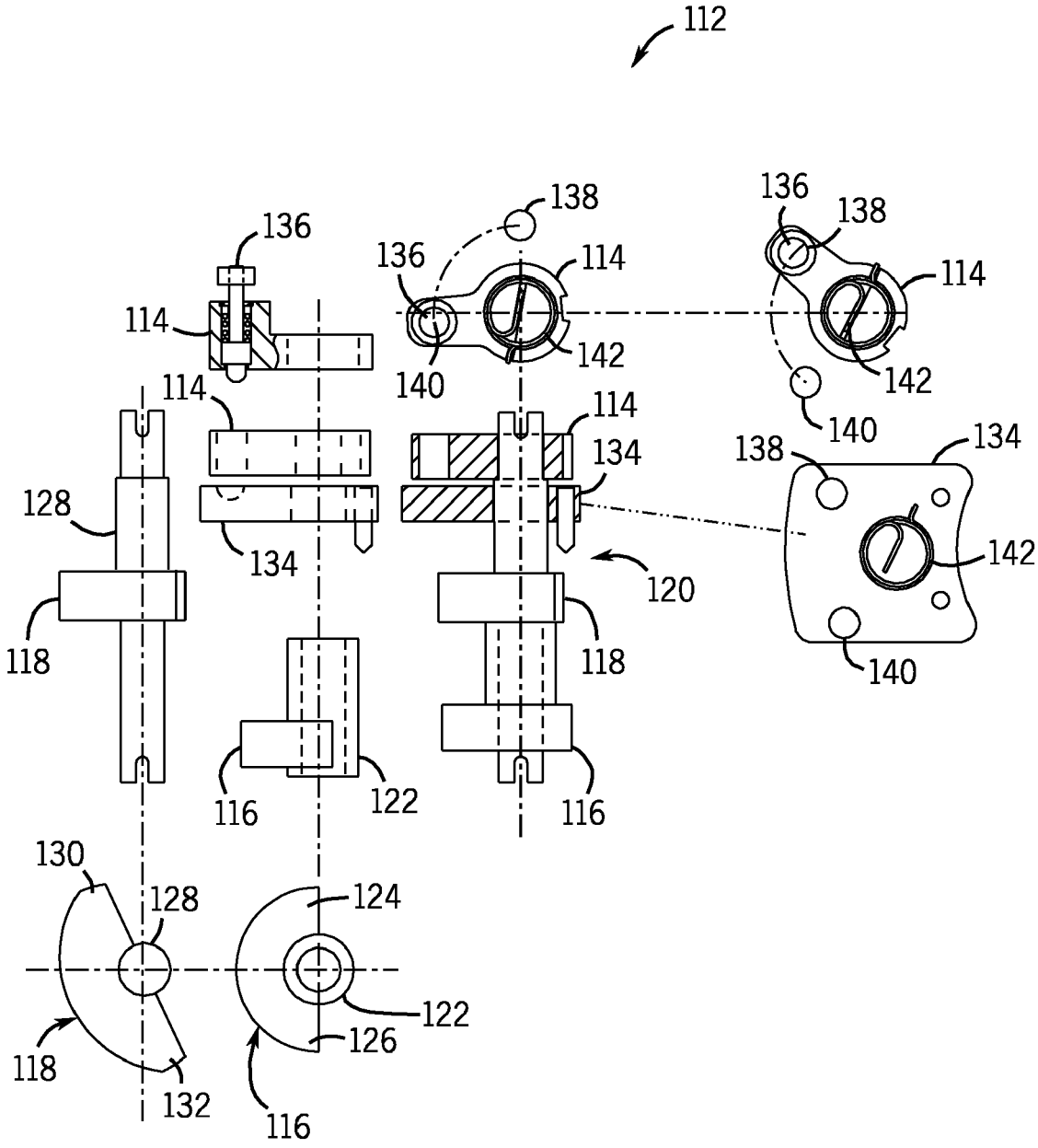
FIG. 6 is an assembly view of the selector assembly of the setting tool, in accordance with an exemplary embodiment of the present technique.

Referring generally to FIG. 6, detailed views of the selector assembly 112 and selector switch 114 are presented. As noted above, the selector assembly 112 is disposed in and rotates with the upper stem section 96. In the illustrated embodiment, the first engagement member 116 is a semicircular body that is disposed on a first rotatable shaft member 122. The semicircular body of the first engagement member 116 has a first tip 124 and a second tip 126. The second engagement member 118 is a generally semicircular body disposed on a second rotatable shaft member 128 and has a first tip 130 and a second tip 132. The first rotatable shaft member 122 is disposed in the second rotatable shaft member 128 to form the rotatable shaft 120. The selector switch 114 is disposed on the rotatable shaft 120. A locking plate 134 is disposed on the upper stem section 96. The rotatable shaft 120 is disposed through a hole in the locking plate 134. A spring-loaded pin 136 is disposed on the selector switch 114 to lock the selector switch 114 in each of the two illustrated positions. The pin 136 engages a first hole 138 in the locking plate 134 to lock the selector switch 114 in the first position and a second hole 140 in the mounting plate 134 to lock the selector switch 114 in the second position. A spring 142 maintains the rotatable shaft 120 biased towards the right-handed direction, in this embodiment.

Figure 7:
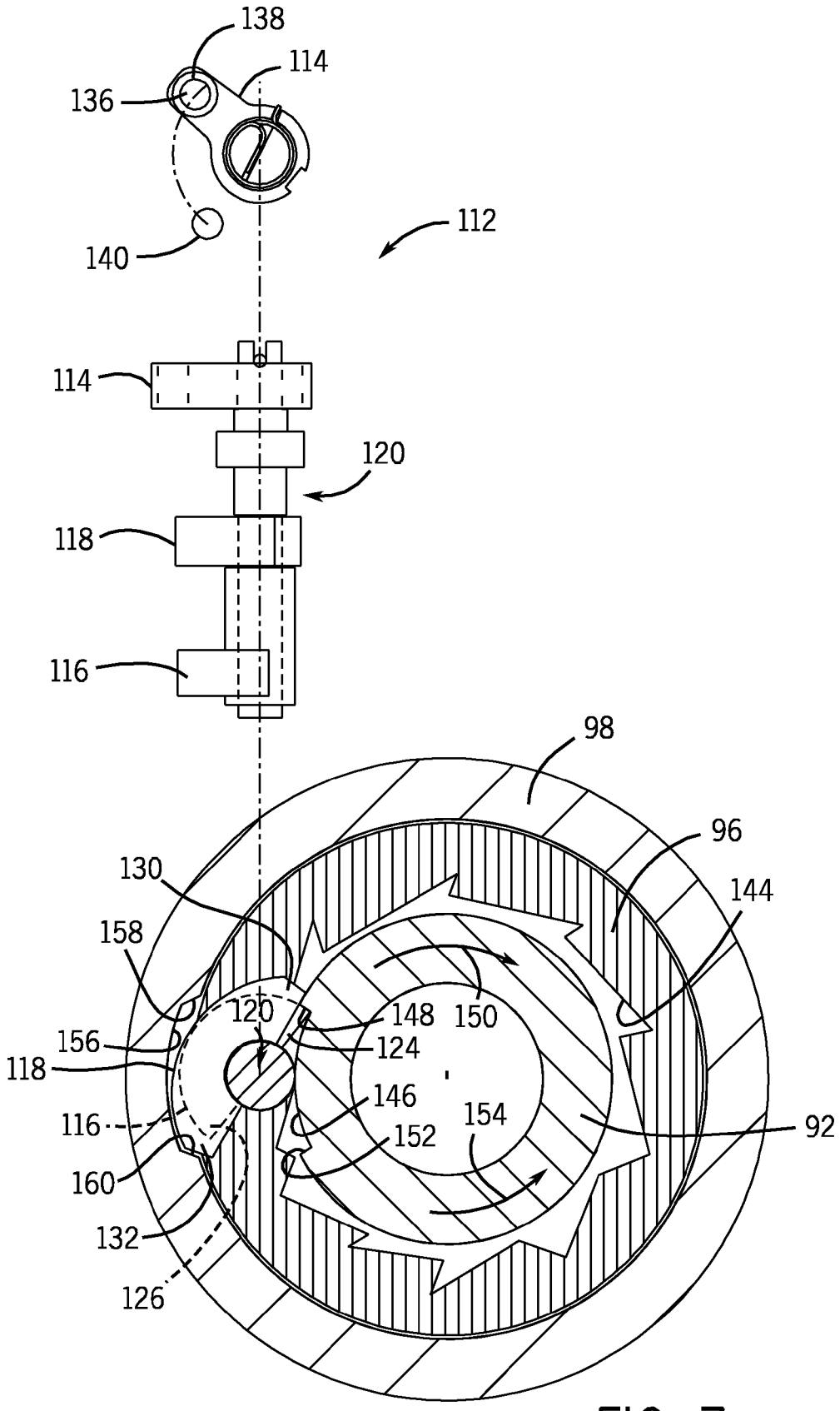
FIG. 7 is a top cross-sectional view of the setting tool with a selector switch positioned in a first position, in accordance with an exemplary embodiment of the present technique.
Figure 8:
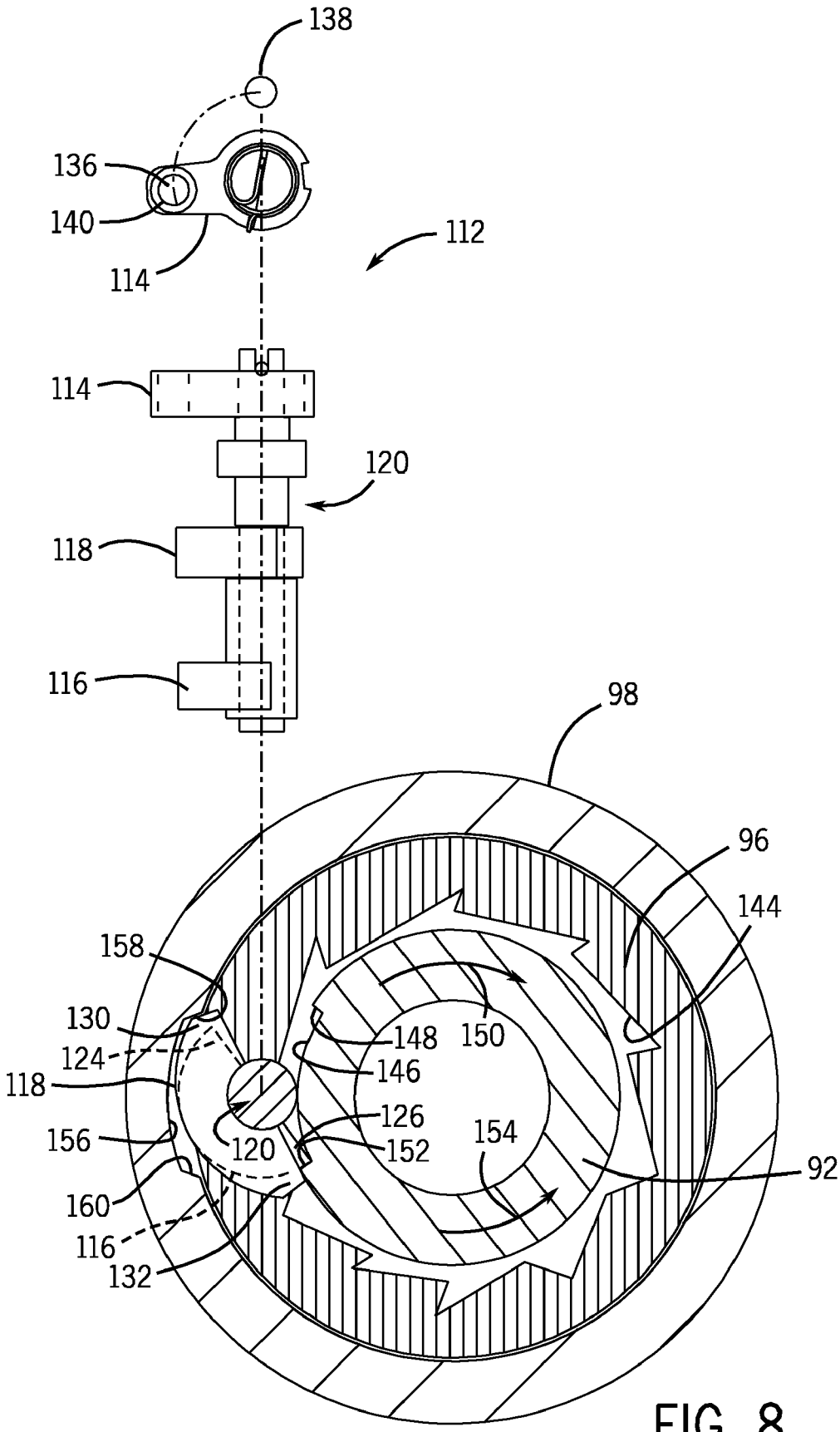
FIG. 8 is a top cross-sectional view of the setting tool with a selector switch positioned in a second position, in accordance with an exemplary embodiment of the present technique.

Referring generally to FIGS. 7 and 8, top cross-sectional views of the lower stem section 92, upper stem section 96, outer sleeve 98, and selector assembly 112 with the selector switch 114 positioned are presented. A portion 144 of the upper stem section 96 has been removed in this view to enable the lower stem section 92 to be seen. In the illustrated embodiment, the lower stem section 92 has a recessed portion 146. A first end 148 of the recessed portion 146 of the lower stem section 92 is configured to receive the first tip 124 of the first engagement member 116 when the upper stem section 96 is rotated in the right-handed direction, as represented by arrow 150. A second end 152 of the recessed portion 146 of the lower stem section 92 is configured to receive the second tip 126 of the first engagement member 116 when the upper stem section 96 is rotated in the left-handed direction, as represented by arrow 154. In the illustrated embodiment, the outer sleeve 98 also comprises a recessed portion 156 having a first end 158 and a second end 160. The first end 158 of the recessed portion 156 of the outer sleeve 98 is configured to receive the first tip 130 of the second engagement member 118 when the upper stem section 96 is rotated in the right-handed direction. The second end 160 of the recessed portion 156 of the outer sleeve 98 is configured to receive the second tip 132 of the second engagement member 118 when the upper stem section 96 is rotated in the left-handed direction.

Referring generally to FIG. 7, a top cross-sectional view of the lower stem section 92, upper stem section 96, outer sleeve 98, and selector assembly 112 with the selector switch 114 positioned in the first position is presented. When the selector switch 114 is in the first position, the first tip 124 of the first engagement member 116 is positioned so that it is received by the first end 148 of the recessed portion 146 of the lower stem section 92. When the upper stem section 96 is rotated in the right-hand direction 150, the first tip 124 of the first engagement member 116 is driven against the first end 148 of the recessed portion 146 of the lower stem section 92, driving the lower stem section 92 into rotation in the right-handed direction 150. Conversely, when the selector switch 114 is in the first position, the second engagement member 118 is positioned so that the first tip 130 of the second engagement member 118 is not received by the first end 158 of the recessed portion 156 of the outer sleeve 98. As a result, when the upper stem section 96 is rotated in the right-handed direction 150, the second engagement member 118 ratchets against the first end 158 of the recessed portion 156 of the outer sleeve 98 and does not rotate the outer sleeve 98.

When the selector switch 114 is in the first position, the second tip 132 of the second engagement member 118 is positioned so that it is received by the second end 160 of the recessed portion 156 of the outer sleeve 98. When the upper stem section 96 is rotated in the left-handed direction 154, the second tip 132 of the second engagement member 118 is driven against the second end 160 of the recessed portion 156 of the outer sleeve 98, driving the outer sleeve 98 into rotation in the left-handed direction 154. Conversely, the first tip 124 of the first engagement member 116 ratchets against the second end 152 of the recessed portion 146 of the lower stem section 92 when the upper stem section 96 is rotated in the left-handed direction and the selector switch 114 is positioned in the first position.

Referring generally to FIG. 8, a top cross-sectional view of the lower stem section 92, upper stem section 96, outer sleeve 98, and selector assembly 112 with the selector switch 114 positioned in the second position is presented. When the selector switch 114 is in the second position, the second tip 126 of the first engagement member 116 is positioned so that it is received by the second end 152 of the recessed portion 146 of the lower stem section 92. When the upper stem section 96 is rotated in the left-hand direction 154, the second tip 126 of the first engagement member 116 is driven against the second end 152 of the recessed portion 146 of the lower stem section 92, driving the lower stem section 92 into rotation in the left-handed direction 154. Conversely, when the selector switch 114 is in the second position, the second engagement member 118 is positioned so that the second tip 132 of the second engagement member 118 is not received by the second end 160 of the recessed portion 156 of the outer sleeve 98. As a result, when the upper stem section 96 is rotated in the left-handed direction 154, the second engagement member 118 ratchets against the second end 160 of the recessed portion 156 of the outer sleeve 98 and does not rotate the outer sleeve 98.

When the selector switch 114 is in the second position, the first tip 130 of the second engagement member 118 is positioned so that it is received by the first end 158 of the recessed portion 156 of the outer sleeve 98. When the upper stem section 96 is rotated in the right-handed direction 150, the first tip 130 of the second engagement member 118 is driven against the first end 158 of the recessed portion 156 of the outer sleeve 98, driving the outer sleeve 98 into rotation in the right-handed direction 150. Conversely, the first tip 125 of the first engagement member 116 ratchets against the first end 148 of the recessed portion 146 of the lower stem section 92 when the upper stem section 96 is rotated in the right-handed direction and the selector switch 114 is positioned in the second position.

Figure 10:
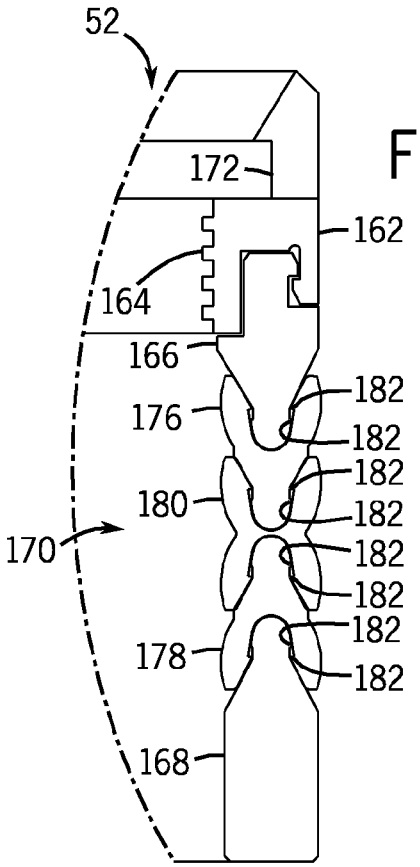
FIG. 10 is a cross-sectional view of the seal of FIG. 9.
Figure 9:
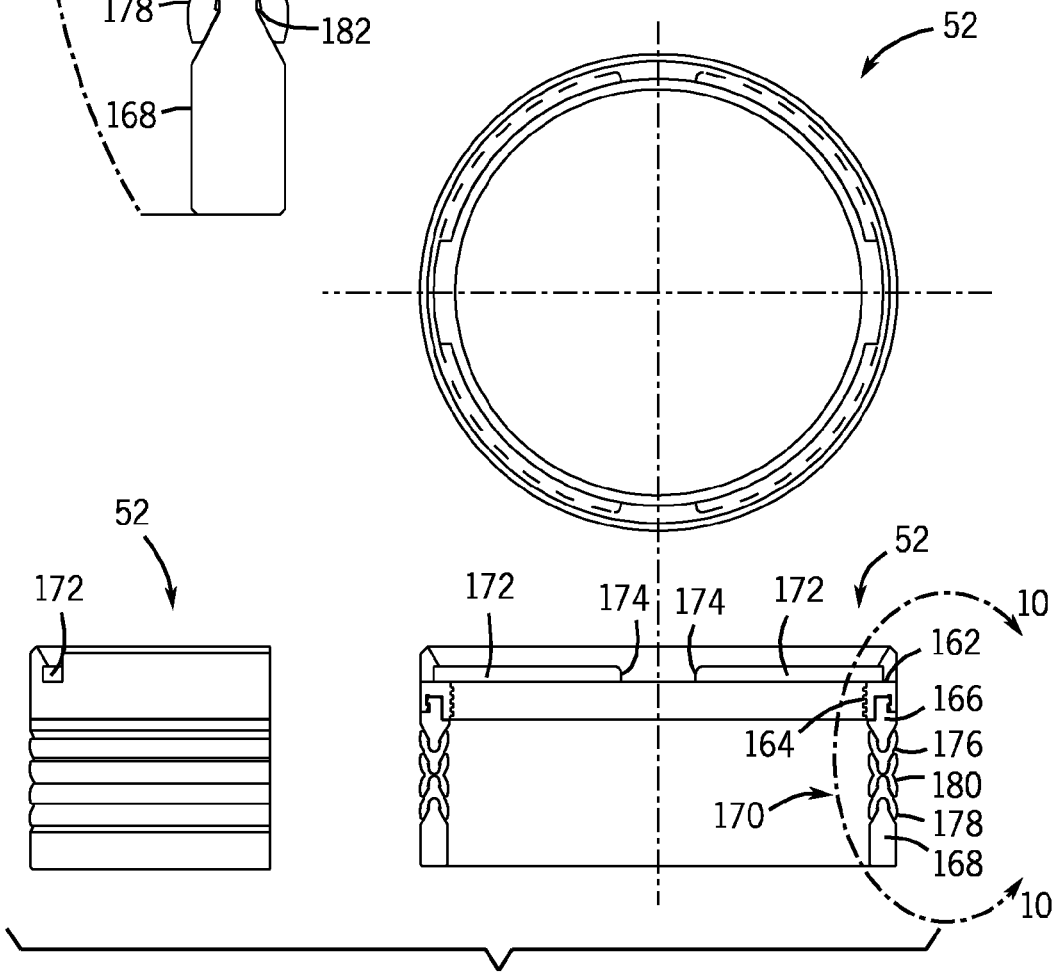
FIG. 9 is an assortment of views of a tubing hanger seal, in accordance with an exemplary embodiment of the present technique.

Referring generally to FIGS. 9 and 10, an exemplary embodiment of the seal 52 for the tubing hanger 42 is presented. As noted above, the setting tool 50 also is used to install the seal 52. The illustrated embodiment of the seal 52 has a threaded ring 162 that has an inner threaded portion 164 that is threaded onto a corresponding threaded portion 121 (FIG. 2) of the tubing hanger 42. This embodiment of the seal 52 also has a first energizing ring 166, a second energizing ring 168, and a sealing element 170 disposed between the two. The first energizing ring 166 is coupled to the threaded ring 162 and the second energizing ring 168 rests on a surface within the wellhead assembly 20. When the threaded ring 162 is threaded onto the tubing hanger 42, the threaded ring 162 is displaced axially so that the first energizing ring 166 is driven toward the second energizing ring 168 with the sealing element 170 captured in between. The sealing element 170 is configured so that it is expanded outward as the first energizing ring 166 drives the sealing element 170 against the second energizing ring 168. The outward expansion of the sealing element 170 forms a seal in the annulus between the tubing hanger 42 and the wellhead 24.

As noted above, the setting tool 50 is stabbed into the seal 52 to enable the setting tool 50 to position the seal 52. In this embodiment, the threaded ring 162 of the seal 52 has a series of J-slots 172 that form a catch for the tabs 104 (FIG. 2) of the setting tool 50. In addition, the threaded ring 164 has a series of end stops 174 to enable the tabs 104 of the setting tool 50 to drive the seal 52 into rotation either during installation or removal.

In the illustrated embodiment, the sealing element 170 of the seal 52 comprises a plurality of sealing members; a first sealing member 176, a second sealing member 178, and a third sealing member 180 that are coupled together. The sealing members may be comprised on an elastomeric material, such as polyaryletheretherketone (PEEK). In this embodiment, the first energizing ring 166 is inserted into the first sealing member 176, the second energizing ring 168 is inserted into the second sealing member 178, and the first and second sealing members 176, 178 are inserted into the third sealing member 180. The sealing members 176, 178, 180 and energizing rings 166, 168 are configured with sloping sides that cooperate to expand the sealing members 176, 178, 180 outward as the sealing members 176, 178, 180 are driven into compression by the energizing rings 166, 168. In addition, each of the first energizing ring 166, the second energizing ring 168, and the sealing members 176, 178, 180 have catches 182. Each catch 182 engages a corresponding catch 182 in an opposite component to facilitate assembly of the seal 52 and removal of the seal 52. When the seal 52 is removed, a lifting force is applied to the first energizing ring 166, the catch 182 of the first energizing ring 166 engages its opposite catch 182 on the first sealing member 176 and transmits the lifting force to the first sealing member 176. In turn, the first sealing member 176 applies a lifting force to the third sealing member 180, and so on until the lifting force is transmitted to the second energizing ring 168, lifting the seal 52 from its position in the wellhead assembly 20.

While only certain features of the invention have been illustrated and described herein, many modifications and changes will occur to those skilled in the art. It is, therefore, to be understood that the appended claims are intended to cover all such modifications and changes as fall within the true spirit of the invention. For example, the techniques described above may be used to secure tubular hangers other than a tubing hanger to a wellhead, such as a casing hanger.

The invention claimed is:

1. A wellhead assembly, comprising:

a wellhead having a bore extending therethrough, the bore having a first profile region; and a tubular hanger adapted to secure to the wellhead, the tubular hanger comprising:

a tubular hanger body;

a first expandable member carried on the tubular hanger body and adapted to expand outward to engage the first profile region of the wellhead, the first expandable member having a first angled surface; and a moveable member carried on the tubular hanger body, the moveable member having a second angled surface facing the first angled surface of the first expandable member;

a threaded ring that is threaded to the tubular hanger body, wherein the moveable member is driven axially relative to the first expandable member by the threaded ring as the threaded ring is rotated relative to the tubular hanger body; and wherein the first angled surface and second angled surface are adapted to cooperate to produce a mechanical advantage to drive the first expandable member outward and the moveable member inward to wedge the moveable member between the first expandable member and the tubular hanger body as the moveable member is driven by the threaded ring against the first expandable member.

2. The wellhead assembly as recited in claim 1, wherein the first expandable member is a split ring.

3. The wellhead assembly as recited in claim 1, wherein the first expandable member comprises a third angled surface on a side of the first expandable member opposite the first angled surface, and the wellhead assembly comprises a member having a fourth angled surface facing the third angled surface, further wherein the third angled surface and the fourth angled surface are adapted to cooperate to produce a mechanical advantage to drive the first expandable member outward and the member having the fourth angled surface inward to wedge the member having the fourth angled surface between the first expandable member and the tubing hanger body as the moveable member is driven by the threaded ring against the first expandable member.

4. The wellhead assembly as recited in claim 1, wherein the tubular hanger is a tubing hanger.

5. The wellhead assembly as recited in claim 1, comprising a second expandable member disposed on the tubular hanger body, the second expandable member being adapted to expand outward to engage a second profile region in the bore of the wellhead that is adapted to receive the second expandable member, wherein the second expandable member is adapted to restrict axial movement of the tubing hanger upon engagement with the second profile region.

6. The wellhead assembly as recited in claim 1, comprising a seal assembly adapted to form a seal between the tubular hanger and the wellhead, the seal assembly having a plurality of seal members joined together to form a sealing element, each seal member having a catch adapted to engage a catch on an adjacent seal member to join the seal members.

7. The wellhead assembly as recited in claim 1, comprising a seal assembly adapted to form a seal between the tubular hanger and the wellhead, the seal assembly having a threaded portion and a sealing element that is expanded outward as the seal assembly is threaded onto a threaded portion of the tubular hanger body.

8. A tubular hanger for reception within a bore of a wellhead, comprising:

a hollow tubular hanger body;

a first expandable member adapted to expand outward to engage a first profile region of the wellhead to support the tubular hanger in the wellhead, the first expandable member having a first angled surface;

a second expandable member adapted to expand outward to engage a second profile region in the bore of a wellhead, wherein the engagement between the second expandable member and the second profile region in the bore of the wellhead aligns the first expandable member with the first profile region of the wellhead; and a moveable member carried on the tubular hanger body, the moveable member having a second angled surface facing the first angled surface of the first expandable member, wherein the first angled surface and second angled surface are adapted to cooperate to produce a mechanical advantage to drive the first expandable member outward to engage the first profile region of the wellhead and the moveable member inward to wedge the moveable member between the first expandable member and the tubular hanger body as the moveable member is driven against the first expandable member.

9. The tubular hanger as recited in claim 8, wherein the first expandable member is a split ring.

10. The tubular hanger as recited in claim 8, comprising a threaded ring threaded onto a threaded portion of the tubular hanger body, wherein the moveable member is driven axially by rotation of the threaded ring along the threaded portion of the tubular hanger body.

11. The tubular hanger as recited in claim 8, wherein the first expandable member comprises a third angled surface on a side of the first expandable member opposite the first angled surface and the tubular hanger comprises a member having a fourth angled surface facing the third angled surface of the first expandable member, further wherein the third angled surface and the fourth angled surface are adapted to cooperate to produce a mechanical advantage to drive the first expandable member outward and the member having the fourth angled surface inward to wedge the member having the fourth angled surface between the first expandable member and the tubing hanger body as the moveable member is driven against the first expandable member.

12. The tubular hanger as recited in claim 8, comprising a seal assembly adapted to form a seal between the tubular hanger and the wellhead, the seal assembly having a plurality of seal members joined together to form a sealing element, each seal member having a catch adapted to engage a catch on an adjacent seal member to join the seal members.

13. A tubular hanger for reception within a bore of a wellhead, comprising:

a tubular body having an axis, an axial passage, and threads at a lower end of the axial passage for securing to a string of pipe;

an inwardly-biased split load ring carried on the body, the load ring having on an upper end a load ring upper angled surface that faces upward and inward, the load ring having on a lower end a load ring lower angled surface that faces downward and inward;

a lower angled ring carried on the body below the load ring, the lower angled ring having an upper angled surface that mates with the load ring lower angled surface;

an upper angled ring carried on the body above the load ring, the upper angled ring having a lower angled surface that mates with the load ring upper angled surface; and a threaded ring that is threaded to the body, wherein the upper angled ring is driven axially downward relative to the load ring by the threaded ring as the threaded ring is rotated relative to the body to wedge the load ring outward into engagement with a profile in the bore of the wellhead.

* * * * *